US006834504B2

(12) United States Patent
Griffin et al.

(10) Patent No.: US 6,834,504 B2
(45) Date of Patent: Dec. 28, 2004

(54) PREMIX BURNER WITH HIGH FLAME STABILITY HAVING A NET-LIKE STRUCTURE WITHIN THE MIXING SECTION

(75) Inventors: Timothy Griffin, Ennetbaden (CH); Peter Jansohn, Kuessaberg (DE); Thomas Ruck, Rekingen (CH)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 10/199,058

(22) Filed: Jul. 22, 2002

(65) Prior Publication Data

US 2003/0031972 A1 Feb. 13, 2003

(30) Foreign Application Priority Data

Jul. 26, 2001 (DE) ..... 101 36 313
Dec. 24, 2001 (DE) ..... 101 64 097

(51) Int. Cl.[7] ..... F02C 1/00; F02G 3/00

(52) U.S. Cl. ..... 60/737; 60/748; 60/39.11; 431/182; 239/575

(58) Field of Search ..... 60/737, 748, 39.11; 431/182, 346; 239/575, 590, 590.5

(56) References Cited

U.S. PATENT DOCUMENTS

| | | | | |
|---|---|---|---|---|
| 4,067,190 A | * | 1/1978 | Hamm et al. | 60/723 |
| 4,082,497 A | * | 4/1978 | Crawford et al. | 431/158 |
| 5,026,273 A | | 6/1991 | Cornelison | |
| 5,051,241 A | | 9/1991 | Pfefferle | |
| 5,440,872 A | | 8/1995 | Pfefferle | |
| 5,453,003 A | | 9/1995 | Pfefferle | |
| 5,622,041 A | | 4/1997 | Feeley et al. | |
| 5,879,148 A | | 3/1999 | Cheng et al. | |
| 6,116,014 A | | 9/2000 | Dalla Betta et al. | |

FOREIGN PATENT DOCUMENTS

| | | |
|---|---|---|
| DE | 4033296 A1 | 4/1991 |
| DE | 4119018 A1 | 12/1992 |
| DE | 4426351 A1 | 2/1996 |
| DE | 19521308 A1 | 12/1996 |
| DE | 15945036 A1 | 6/1997 |
| DE | 19640818 A1 | 4/1998 |
| EP | 0536197 A1 | 2/1990 |
| EP | 0321809 B1 | 5/1991 |
| EP | 0686813 A2 | 12/1995 |
| EP | 069470 A2 | 1/1996 |
| EP | 0780629 A2 | 6/1997 |
| EP | 0918152 A1 | 5/1999 |
| EP | 0918153 A1 | 5/1999 |
| EP | 0945677 A2 | 9/1999 |
| EP | 0987491 A1 | 3/2000 |
| EP | 0780629 B1 | 7/2001 |
| WO | 93/17279 | 9/1993 |

* cited by examiner

*Primary Examiner*—Justine R. Yu
(74) *Attorney, Agent, or Firm*—Burns, Doane, Swecker & Mathis, L.L.P.

(57) ABSTRACT

The invention relates to a premix burner with high flame stability for use in a heat generator, preferably in the combustion chamber of a gas turbine. Modern, lean-operated premix burners enable very low noxious emissions, but sometimes operate very close to the extinction limit. To increase the stability of the lean premix combustion by increasing the distance between flame temperature and extinction limit temperature the invention proposes to equip the burner in the mixing zone (200) with a net-like structure (201) for the premixing of combustion air and fuel. According to a preferred embodiment, the net-like structure (201) consists of a plurality of layers of individual wire mesh fabrics (202) arranged at a distance from each other. The wire mesh fabrics (202) are preferably equipped with an oxidation-promoting, catalytically active surface. It was found that the net structure (201) positively influences the thermoacoustic behavior of the burner and dampens and insulates pressure waves from the combustion chamber (300), and in this way reduces the excitation of pressure waves in the combustion chamber (300).

19 Claims, 4 Drawing Sheets

PREMIX BURNER WITH HIGH FLAME STABILITY HAVING A NET-LIKE STRUCTURE WITHIN THE MIXING SECTION

FIELD OF THE INVENTION

The invention relates to a premix burner for a heat generator, in particular for use in a gas turbine system according to the preamble of Claim 1.

BACKGROUND OF THE INVENTION

EP 0 321 809, WO 9317279, as well as EP 0 945 677 have disclosed premix burners in which a combustion air stream is fed via a swirl generator tangentially into an interior burner chamber and is mixed with fuel. Gaseous fuels, e.g. natural gas, are injected along tangential air inlet slits into the combustion air stream, whereas liquid fuels, such as heating oil, are injected preferably via a central nozzle at the burner head. At the burner outlet, the resulting eddy current bursts open at a change in the cross-section, inducing a backflow zone used for stabilizing the flame while the burner is being operated.

In order to prevent interference with the flow field under the conditions of use in gas turbines, even if fuels of different origin and composition are used, and in this way always achieve a safe flame position, the teaching of EP 0 780 629 provides that downstream from the swirl generator a mixing section may be provided that ensures a better premixing of different types of fuels.

While burners designed in such a way enable operation with very low noxious emissions, they frequently operate very close to the extinction limit of the flame: The usual flame temperatures achievable with the lean premix flames of such burners are about 1700 K to 1750 K. Under certain operating conditions, the extinction limit of the flames may already be reached at 1650 K. This value is relatively high. The reason for this is the low fuel content of the fuel/air mixture that reduces the flame speed, which then results in a spatially larger and therefore more instable flame front.

However, a richer mixture would increase the noxious emissions and make the use of lean premix burners absurd.

It is also known that many times thermoacoustic oscillations occur in the combustion chambers of gas turbines, resulting in undesired effects, such as too high mechanical stress, increased $NO_x$ emissions due to inhomogeneous combustion, and even extinction of the flame. Since, in order to achieve low $NO_x$ emissions, an increasing part of air is passed through the burners themselves, the sound-dampening effect of the cooling air flowing into the combustion chamber is reduced, so that the problems associated with undesired oscillations increasingly occur especially in such modern gas turbines.

SUMMARY OF THE INVENTION

The present invention is based on the objective of improving the stability of the lean premix combustion of modern burners of the initially mentioned type, as used in particular in the combustion chambers of gas turbines. In order to ensure operation with low noxious emissions, any significant increase in the combustion temperature must hereby be avoided.

According to the invention, this objective is realized with a premix burner of the type mentioned in Claim 1. The secondary claims represent advantageous embodiments of such a burner.

The basic idea of the invention consists of equipping a mixing section of a premix burner with a net-like structure that extends at least almost completely over the flow cross-section of the mixing section.

According to a preferred embodiment, the net-like structure consists of a wire mesh or a plurality of layers of wire mesh arranged at a distance from each other.

An arrangement of five to 100, in particular ten to 20, wire mesh fabrics oriented at least approximately vertically to the longitudinal burner axis was hereby found to be advantageous.

According to an alternative embodiment, the net-like structure consists of a porous body, made of a foam material that is integrated into the burner chamber.

The net-like structure preferably should be designed so that it causes no negligible pressure loss or formation of local eddies that could substantially affect the flow in the mixing section.

In an embodiment based on wire mesh fabrics, this is ensured by selecting the dimensions of the wire thickness and mesh width with respect to each other in such a way that the largest possible, open sieve surface, preferably in a magnitude of more than 90%, remains.

By varying the open sieve surface across the cross-section, it is possible to influence the flow conditions in the mixing section in a targeted manner.

In this context, it was found to be advantageous to support the edge flow with an increase in the open sieve surface towards the edge zone.

Metal- or ceramic-based materials have a sufficient resistance against the existing thermal and chemical stresses, whereby metallic materials, especially aluminum-containing or -treated iron or steel alloys, are preferred in view of a reduction of the combustion chamber oscillations.

In a supplementary, especially preferred embodiment, the net-like structure is provided with a catalytically effective surface for supporting combustion.

It was shown that the thermoacoustic behavior of the burner can be positively changed with a net-like structure extending over the entire flow cross-section, and that as a result of this change a reduction of the oscillation tendency of the burner and therefore a stabilization of the flame are found. This positive effect apparently can be attributed to the nature of the net structure, i.e. the insulation and dampening of the sound waves propagating inside the combustion chamber. Pressure waves from the combustion chamber in the direction of the gas injection are partially dampened and partially insulated by the structure, i.e. are let through at a changed frequency or are reflected again. The essentially shorter propagation length of the sound waves reflected back into the combustion chamber causes the excitation of pressure oscillations in the combustion chamber to be shifted towards other frequency ranges and to be reduced.

The dampening and insulation behavior of the net structure is influenced by its material and dimensions.

This stabilizing effect of the net structure is additionally reinforced by the oxidation-promoting, catalytic action of its surface.

The mentioned effects result in synergies, which ultimately shift the extinction limit towards lower flame temperatures and therefore, at the same combustion temperature, improve the flame stability by increasing the interval between flame temperature and extinction limit temperature.

Another feature of the invention that should be emphasized is that existing burners can be retrofitted with little expenditure.

The invention can be used in premix burners known to the expert as such from the previously cited state of the art. The invention can be easily combined with all burner types disclosed in the cited publications and further developed from these publications and known per se to the expert; in view of the many possible forms of embodiments, these burner types are only incompletely reflected in the preferred embodiments mentioned in the secondary claims.

BRIEF DESCRIPTION OF DRAWINGS

Other features, advantages, and details of the invention will be explained below in an exemplary embodiment in reference to schematic drawings.

Only those elements essential to the invention are shown. Identical or corresponding elements are designed with the same reference numerals.

DETAILED DESCRIPTION OF THE INVENTION

Figure 1:
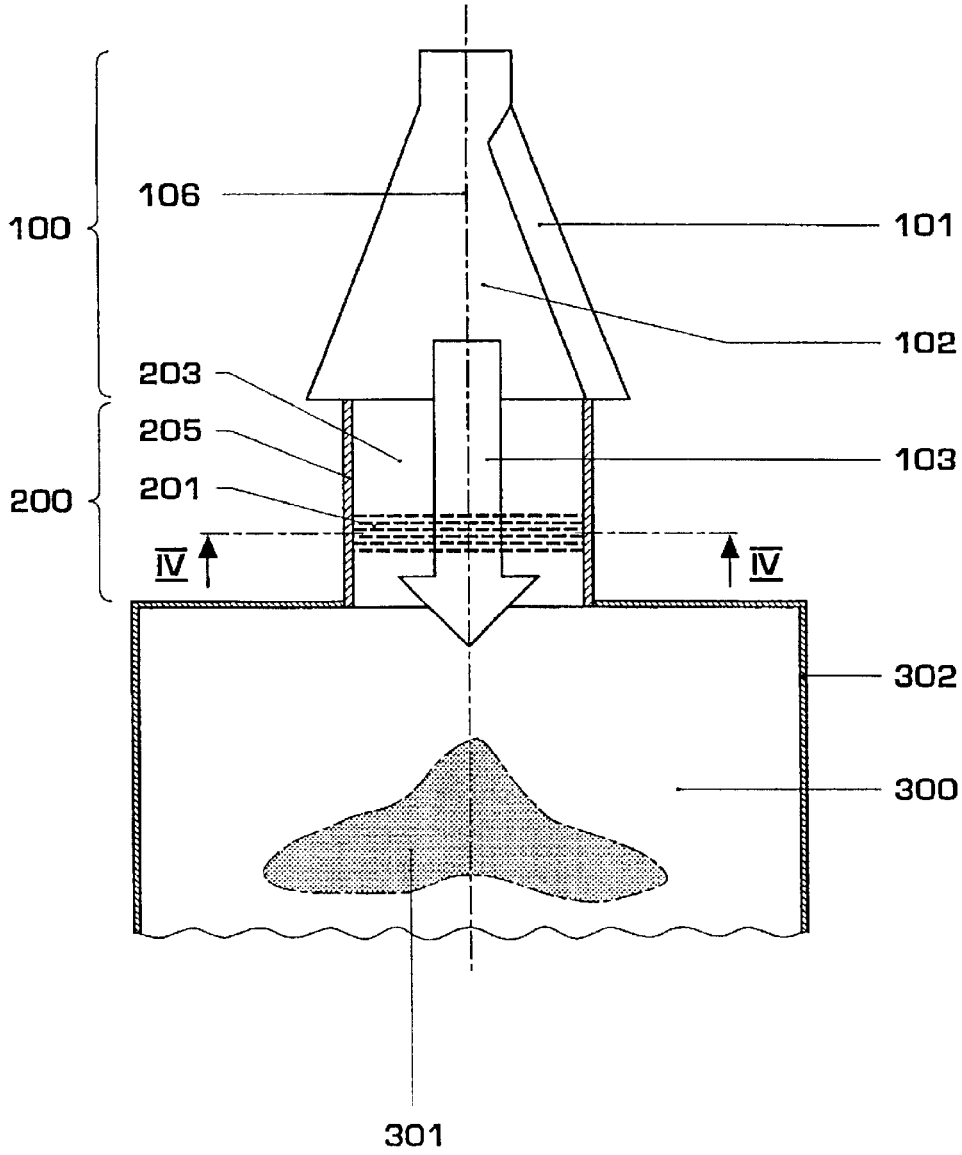
FIG. 1 is a schematic illustration of an exemplary embodiment of the invention.

FIG. 1 is a very schematic illustration of the concept of the invention. At the beginning, a swirl generator (100) operates. This swirl generator may be an actually known premix burner as described, for example, in the publications cited in this specification. The burners cited as examples are all based on a common principle. They have an axially extending, at least approximately rotation-symmetrical chamber (102) into which combustion flows via inlet slits (101) extending preferably parallel to the longitudinal axis (106). As a result of the tangential orientation of these more or less slit-shaped inlet openings (101), the combustion air experiences a strong, tangential velocity component, resulting in interaction with the axial component directed towards the burner mouth or outlet, in a swirl flow (103) through said interior chamber (102). The enrichment of the combustion air with fuel takes place alternatively or complementarily via means (104) on the housing mantle near the combustion air inlet slits (101) and/or via central feeding means (105) in the burner axis (106).

These burners furthermore have in common that the flow cross-section steadily increases in the direction towards the burner mouth outlet in order to maintain approximately constant flow conditions with the increasing mass flow. Although the burners mentioned in this publication as examples are based on the described, uniform principle, this invention shall not be limited to this special type of premix burners whose flame stability should be increased while maintaining steady, low noxious emissions.

According to the invention, a net-like structure (201) is arranged in a downstream part of the burner within the mixing section (200) of the combustion air with the fuel(s). This net structure (201) consists of at least one wire mesh (202) spanning over the flow cross-section (203).

The one or more wire mesh fabrics (202) hereby have a mesh width in the range from 250 $\mu$m to 1000 $\mu$m, and a wire thickness of 100 $\mu$m to 500 $\mu$m. To prevent a negative effect on the flow conditions, these parameters of the wire mesh (202) hereby must be selected with respect to each other in such a way that the largest possible open sieve surface, preferably in a magnitude of more than 90%, remains. When arranging several wire mesh fabrics (202) spanning the flow cross-section (203), their distance to each other should correspond at least to the wire thickness.

As already explained previously, the net structure (201) has a positive effect on the thermoacoustic behavior of the burner. It is known that in burners of this type a non-negligible problem occurs, namely the formation of shearing layers between the hot combustion gases in the combustion chamber and the exiting mixture of combustion air and fuel. These shearing layers initiate so-called Kelvin-Helmholtz waves, which under operating conditions result in reaction rate fluctuations and resulting thermoacoustic oscillations with a typical frequency. In cooperation with the inherent oscillations of the system, these thermoacoustic oscillations create significant problems for the burner operations, even up to an extinction of the lean-operated flame.

The pressure waves propagating inside the combustion chamber (300) impact the wire mesh (202) and cause it to oscillate. The oscillation energy is hereby partially absorbed by the tissue (202) and partially, with shifting towards other frequency ranges, returned downstream into the combustion chamber (300) or is fed upstream towards the gas injection.

These dampening and insulation effects of the tissue (202) contribute to an oscillation stabilization of the combustion process.

To support flame stability, according to a supplementary embodiment, the wire mesh (202) also may have a catalytic coating that promotes the combustion process. Possible catalysts are actually known materials, such as precious metals (Pd, Pt, Rh etc.), [or] metal oxides ($MnO_2$, NiO, etc.), alone or in combination with a co-catalyst.

Although in principle a plurality of actually known high-temperature-resistant metallic and ceramic materials are suitable for this purpose, metallic materials are most suitable for fulfilling the requirements for catalysts with respect to oscillation reduction and carrier properties. Good results are obtained with materials based on aluminum-containing or aluminum-treated iron or steel alloys. If these materials contain a sufficiently high aluminum content, aluminum whiskers form on the surface during oxidation, causing a rough and chemically active surface that is suited very well as a carrier for a catalytically active coating material.

According to one advantageous embodiment, the steel mesh is coated with a porous, ceramic material that contains catalyst material.

The connection of the net structure (201) with the surrounding housing wall (205) may be accomplished in any suitable manner. Depending on the actual conditions of the respective application, the expert has a number of possibilities available. Two advantageous embodiments are described in reference to the embodiments according to FIGS. 2 and 3.

Figure 2:
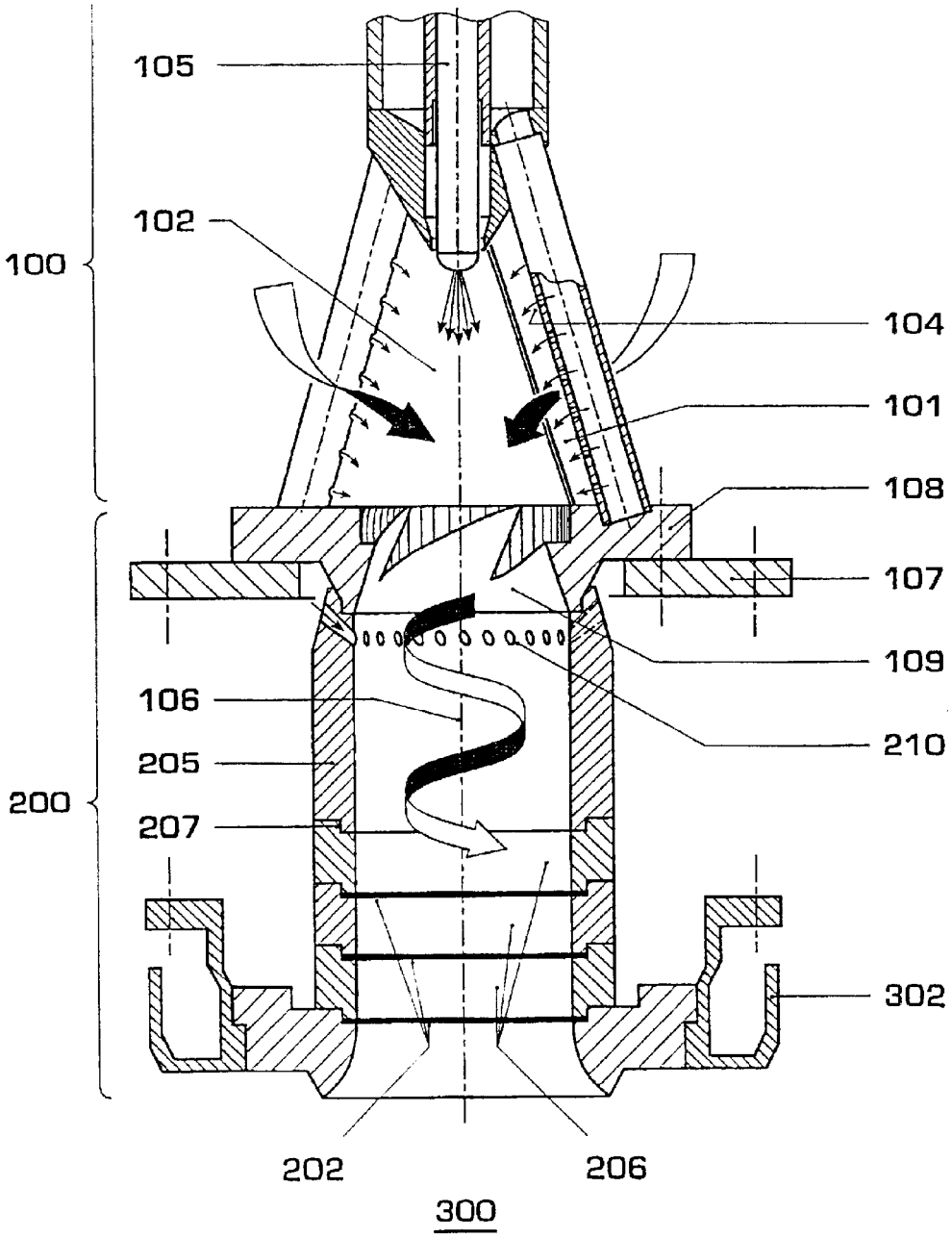
FIGS. 2 and 3 are schematic illustrations of an exemplary embodiment of the invention with a premix burner as disclosed in EP 0 780 629.
Figure 3:
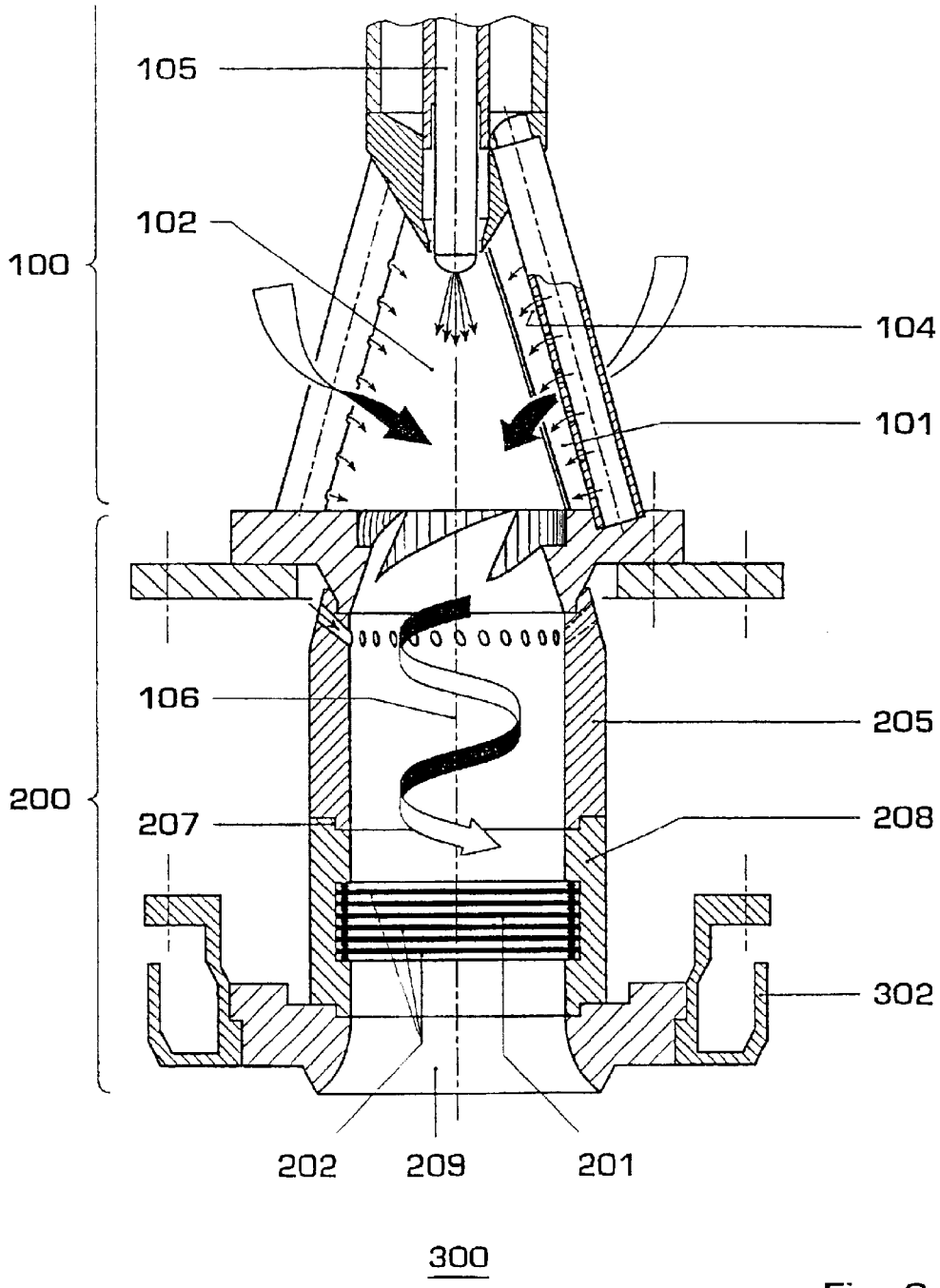

FIGS. 2 and 3 show the realization of the invention with a premix burner as disclosed in EP 0 780 629.

The burner consists essentially of a swirl generator (100) for a combustion air stream and is constructed of at least two conical partial bodies that are offset with their axes in relation to the burner axis (106) as well as laterally offset in relation to each other. Because of this lateral offset of the partial bodies, tangential inlet slits (101) are constructed between the partial bodies. As a result of the tangential inlet slits (101), a combustion air stream flows essentially tangentially into the inside chamber (102) of the swirl generator (100). As a consequence, a swirl flow (103) forms inside the swirl generator (100), the axial flow component of which swirl flow is directed towards the down-stream mouth of the swirl generator (100). The partial bodies are attached at the downstream end of the swirl generator (100) on a retainer ring (107). In addition, a transition element (108) is arranged in the retainer ring (107). This transition element is provided with a number of transition channels (109) that transport the swirl flow (103) generated in the swirl generator (100) from the inflowing combustion air without any abrupt cross-section changes into the mixing segment (200). This mixing segment (200) is used to produce the most homogeneous mixture possible of combustion air and fuels of various types. The mixing segment (200) enables a loss-free flow guidance while preventing a backflow zone from forming. The mixing quality for all types of fuel can be influenced over the length of the mixing section (200). The downstream end of the mixing section (200) is followed by the combustion chamber (300), whereby a cross-section change exists at the transition point, behind which cross-section change forms a central backflow zone (301) that has the properties of a flame holder. In the backflow zone (301), a flame of the premixed fuel/air mixture is able to stabilize. Based on the good premixing of air and fuel, this flame can be operated with a quite high excess of air—as a rule, air values of two or more are found at the burner itself. Because of the relatively cool combustion temperatures, very low nitrogen oxide emissions can be achieved with such burners without complicated post-treatment of the waste gases. Because of the good pre-mixing of the fuel with the combustion air and a good flame stabilization due to the backflow zone (301), a continued, very good burn-out occurs in spite of the low combustion temperatures, and thus low emissions of partial or unburned components occur, in particular carbon monoxide and unburned hydrocarbons, but also of other undesirable organic compounds.

A velocity profile with a distinct maximum on the center axis (106) is present across the flow cross-section (203) of the mixing section (200). In the direction towards the edge zone (204), a significant reduction in the axial velocity is recorded. To safely exclude the risk of a flashback in this area (204) also, the state of the art provides a number of through-channels (210), through which an additional air volume is fed into the mixing section (200), i.e. in such a way that it induces along the flow-limiting wall (205) an increase in the axial flow velocity in this edge zone (204) by forming a film.

Figure 4A:
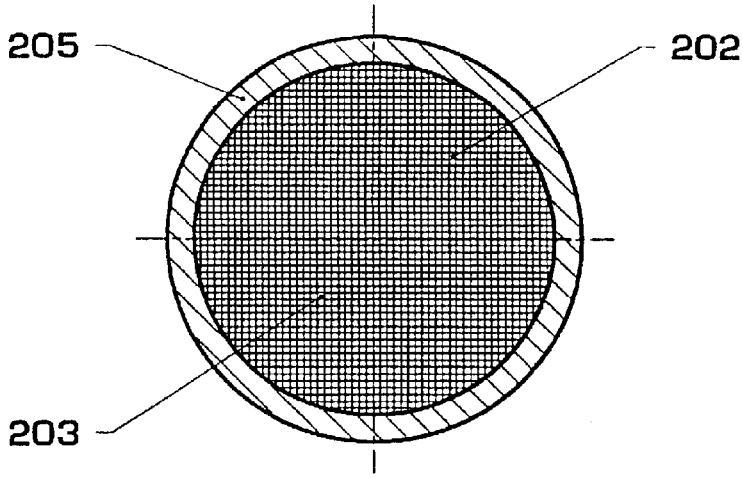
FIG. 4*a* is a cross-sectional view of the apparatus along the line IV-IV in FIG. 1.
Figure 4B:
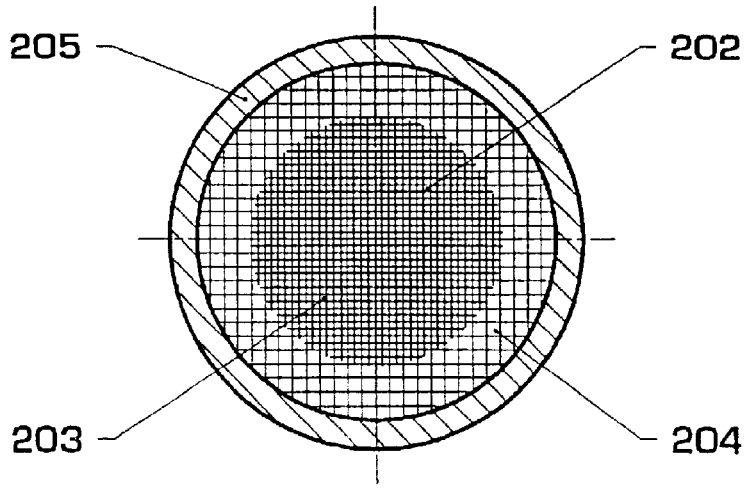
FIG. 4*b* is a schematic illustration of a supplementary embodiment of the invention.

According to a supplementary embodiment of the invention, as shown in FIG. 4*b*, the wire mesh (202) has a sieve surface in the area of this edge zone (204) that is more open than in the radially inner area. This measure promotes the edge flow and hereby contributes to a strengthening of the ring stabilization of the backflow zone (301) and reduction of the risk of a flashback.

In order to attach the wire mesh (202), the housing (205) surrounding the mixing section (200) is composed like segments of individual lengths of pipe (206), at the joints (207) of which the wire mesh fabrics (202) have been integrated. This embodiment, shown schematically in FIG. 2, is characterized by an easy replacement of spent mesh fabrics (202).

An alternative embodiment, shown in FIG. 3, consists of composing the housing (205) of individual segments (206), whereby at least one segment (208) was equipped in a previous work process with the wire mesh fabrics (202).

The above described embodiments should in no way be understood as to limit the invention. In contrary, they should be understood in an instructive sense and as an outline of the versatility of the embodiments made possible within the framework of the invention as characterized in the claims.

The previous explanations provide the expert with illustrative examples for the large number of possible embodiments of the burner according to the invention and characterized in the claims, as well as for its advantageous ways of operation. But these should not be understood to limit the invention.

List of Reference Numerals

100 swirl generator
101 tangential inlet slits
102 inner chamber of swirl generator
103 swirl flow
104 means for fuel injection
105 central fuel nozzle
106 longitudinal burner axis
107 retainer ring
108 transition element
109 transition channels
200 mixing section
201 net-like structure
202 wire mesh
203 flow cross-section
204 edge zone
205 housing surrounding mixing section (200)
206 housing pipe length, segment
207 Joint between housing pipe lengths
208 housing segment equipped with net-like structure (201)
209 outlet geometry of mixing section (200)
210 through-channels
300 combustion chamber
301 backflow zone
302 combustion chamber wall

What is claimed is:

1. Premix burner with high flame stability for use in a heat generator, preferably of a gas turbine, comprising:

a swirl generator with means for the tangential feeding in of a combustion air flow into an inner chamber of the swirl generator, means for feeding in at least one fuel into the combustion air stream while forming a swirl flow with an axial movement component towards a burner mouth, a mixing section located downstream from the swirl generator for premixing the combustion air with the at least one fuel, a net-like structure arranged within the mixing section and extending at least approximately over an entire flow cross-section of the mixing section, wherein an open sieve surface of the net-like structure increases radially from an inside area to an outside area over the flow cross-section of the mixing section for promoting an edge flow.

2. Premix burner according to claim 1, wherein the net-like structure is composed of one or more individual wire mesh fabrics that are spaced apart from each other.

3. Premix burner according to claim 2, wherein the net-like structure consists of five to 100, preferably 10 to 20, wire mesh fabrics spaced apart from each other and oriented at least approximately vertically to a longitudinal burner axis.

4. Premix burner according to claim 2, wherein the individual wire mesh fabrics are arranged essentially parallel and at even intervals.

5. Premix burner according to claim 7, wherein an axial distance between the individual wire mesh fabrics corresponds to at least a wire thickness.

6. Premix burner according to claim 1, wherein the net-like structure has a mesh width in the range from 250 $\mu$m to 1000 $\mu$m, and a wire thickness of 100 $\mu$m to 500 $\mu$m.

7. Premix burner according to claim 1, wherein the net-like structure is a porous body of a foamed metallic material or foamed ceramic material.

8. Premix burner according to claim 1, wherein the net-like structure is arranged close to the outlet geometry of the mixing section.

9. Premix burner according to claim 1, wherein the net-like structure is based on a high temperature-resistant, metallic material.

10. Premix burner according to claim 9, wherein the net-like structure is based on steel alloy.

11. Premix burner according to claim 10, wherein the net-like structure includes an aluminum-containing steel alloy.

12. Premix burner according to claim 1, wherein the net-like structure is based on a ceramic material.

13. Premix burner according to claim 12, wherein the net-like structure is based on silicon, zirconium, or aluminum compound.

14. Premix burner according to claim 1, wherein at least one wire mesh of the net-like structure has a catalytically active surface.

15. Premix burner according to claim 14, wherein the wire mesh includes a steel alloy and has a porous, ceramic coating provided with a catalytic material.

16. Premix burner according to claim 1, wherein a housing surrounding the mixing section is composed of individual lengths of pipe, and one or more layers of wire mesh of the net structure are integrated in a form-derived or force-derived manner into joints between the individual lengths of pipe.

17. Premix burner according to claim 1, wherein the net structure is integrated in an exchangeable length of pipe of a housing surrounding the mixing section.

18. Premix burner according to claim 1, wherein the net-like structure has a ring-shaped edge zone with a larger open sieve surface than the inside area.

19. Premix burner according to claim 18 for operating in a combustion chamber of a gas turbine section.

* * * * *